United States Patent [19]

Ermel et al.

[11] 4,071,296

[45] Jan. 31, 1978

[54] ELECTROSTATIC-COPIER CLEANING DEVICE

[75] Inventors: Heinrich Ermel, Munich; Franz Fruth, Unterpfaffenhofen; Georg Fryda; Peter Lang, both of Munich; Fritz Rau, Unterhaching; Jürgen Vossnacke, Hohenschaftlarn, all of Germany

[73] Assignee: AGFA-Gevaert, AG, Leverkusen, Germany

[21] Appl. No.: 658,603

[22] Filed: Feb. 17, 1976

[30] Foreign Application Priority Data

Feb. 19, 1975 Germany ..... 2507152

[51] Int. Cl.[2] ..... G03G 21/00

[52] U.S. Cl. ..... 355/15; 15/256.52; 118/652; 355/3 R

[58] Field of Search ..... 355/15, 3 R, 3 DD; 15/1.5, 256.5, 256.51, 256.52; 118/652, 653–658, 637

[56] References Cited

U.S. PATENT DOCUMENTS

| | | | |
|---|---|---|---|
| 3,625,605 | 12/1971 | Schnall et al. | 355/15 |
| 3,633,544 | 1/1972 | Weiler | 118/637 X |
| 3,667,840 | 6/1972 | Engel et al. | 355/15 X |
| 3,672,764 | 6/1972 | Hartwig et al. | 355/15 |
| 3,791,730 | 2/1974 | Sullivan | 355/3 DD |
| 3,809,012 | 5/1974 | Delvecchio | 118/637 |
| 3,838,472 | 10/1974 | Oriel | 355/15 X |
| 3,872,826 | 3/1975 | Hanson | 118/637 X |
| 3,879,124 | 4/1975 | Eppe et al. | 355/15 |
| 3,906,899 | 9/1975 | Harpavat | 118/637 |
| 3,918,402 | 11/1975 | Ohta | 118/637 |

*Primary Examiner*—Richard L. Moses
*Attorney, Agent, or Firm*—Michael J. Striker

[57] ABSTRACT

A cleaning device for an electrostatic copier of the type having an endless travelling charge carrier provided with a photosensitive surface which is electrostatically chargeable to form a latent image to which toner particles are attracted for subsequent transfer to an image carrier. The cleaning arrangement removes residual toner particles from the surface prior to the next electrostatic charging thereof and is in form of a cleaning cartridge that can be inserted into and removed from the copier in toto. The cartridge has a leading open end and instrumentalities at this end which engage the photosensitive surface of the charge carrier when the cartridge is inserted into the copier. Elastically deformable sealing elements are provided on the cartridge and at least in part bound the open end thereof, yieldingly engaging the photosensitive surface in response to the insertion of the cartridge into the copier.

6 Claims, 1 Drawing Figure

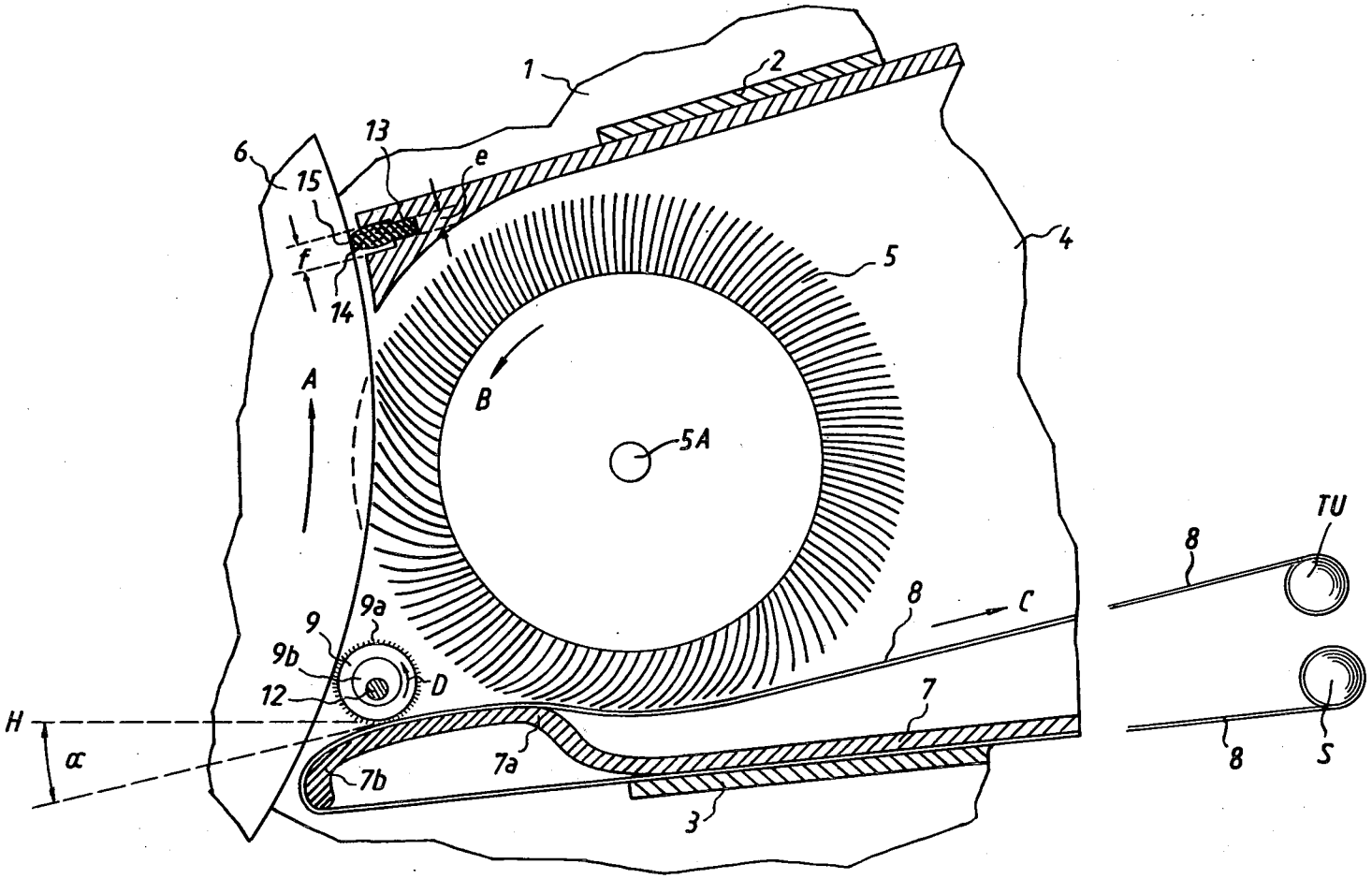
TU
S
8
8
4
C
8
7
5
2
5A
3
1
B
7a
e
D
13
9a
7b
14
15
f
A
9
9b
12
6
α
H

ELECTROSTATIC-COPIER CLEANING DEVICE

BACKGROUND OF THE INVENTION

The present invention relates generally to electrostatic copiers, and more particularly to an electrostatic-copier cleaning device.

Electrostatic copiers known in the art have an endless travelling charge carrier, usually in form of a cylindrical drum, the surface of which can be electrostatically charged to form on it a latent image of an original to be copied. To the electrostatic charge on this surface toner particles are attracted to form an image which is thereupon transferred to an image carrier to form a copy of the original. Before the charge carrier can be recharged for making the next copy, i.e., for the next operating cycle, residual toner particles which continue to adhere to the photosensitive surface of the carrier, must be removed.

For this purpose it is known in the art to provide cleaning stations in such electrostatic copiers. These cleaning stations usually employ rapidly rotating brush rollers, which may be of the bristle type or the type where the bristles are replaced by synthetic plastic foam material, or other devices used for removing residual toner particles from the charge carrier surface cause a substantial accumulation of the dust-like toner particles in the cleaning station. It is known to provide the cleaning arrangement in form of units which can be inserted into or removed from the housing of the electrostatic copier in toto. It has also been proposed to protect the remainder of the carrier against the toner dust that is removed at the cleaning station by constructing the cleaning units as a dust-tight cassette or cartridge with the purpose of preventing the escape of toner dust from the cartridge into the surrounding interior space of the electrostatic copier.

However, this prior-art proposal has been only partially successful, because the cartridge must of course have an open side which faces towards the photosensitive surface of the travelling charge carrier and at which the toner-removing cleaning instrumentalities, e.g., rotating brushes or the like, are located. In this region of the open side or end of the cartridge, therefore, dust continues to escape into the ambient interior spaced of the copying machine. Particularly, the two horizontal slots along the open end of the cartridge at the upper and lower edges bounding this end, i.e., the slots defined between these edges and the photosensitive surface of the charge carrier, have not heretofore been sealed at all, because no way could be conceived in which these slots could be properly sealed against the escape of toner dust on the one hand, without on the other hand damaging the highly scratch-sensitive surface of the charge carrier.

SUMMARY OF THE INVENTION

Accordingly, it is an object of the present invention to provide an improved electrostatic copier wherein the aforementioned disadvantages are avoided.

More particularly, it is an object of the invention to provide an electrostatic-copier cleaning device which is not possessed of these disadvantages of the prior art.

An additional object of the invention is to provide such a cleaning device wherein the aforementioned areas are properly sealed against the escape of dust.

An additional object of the invention is to provide such a cleaning device which is simple in is construction and wherein the sealing arrangement will not damage the photosensitive surface of the travelling charge carrier.

Still a further object of the invention is to provide such a cleaning device wherein the sealing elements used for the sealing purposes engage the photosensitive surface of the travelling charge carrier with a relatively large surface area.

Pursuant to these objects, and others which will become apparent hereafter, one feature of the invention resides in an electrostatic copier of the type having an endless travelling surface which is electrostatically chargeable to form a latent image to which toner particles are attracted for subsequent transfer to an image carrier, and a cleaning arrangement for removing residual toner particles from said surface prior to the next electrostatic charging thereof.

According to the invention a cleaning cartridge is provided which is adapted for in toto insertion and removal from the copier. The cartridge has a leading open end and cleaning means at this open end so as to engage the photosensitive surface when the cartridge is inserted into the copier. Elastically deformable sealing means is provided on the cartridge, at least in part bounding the open end and yieldingly engage the photosensitive surface in response to insertion of the cartridge into the copier.

The novel features which are considered as characteristic for the invention are set forth in particular in the appended claims. The invention itself, however, both as to its construction and its method of operation, together with additional objects and advantages thereof, will be nest understood from the following description of specific embodiments when read in connection with the accompanying drawings.

BRIEF DESCRIPTION OF THE DRAWINGS

The single FIGURE is a fragmentary somewhat diagrammatic vertical section through a portion of an electrostatic copier embodying the invention.

DESCRIPTION OF A PREFERRED EMBODIMENT

Electrostatic copies of the type in question are extremely widely known and, therefore, no attempt has been made to show or explain their operation or those parts of such carriers which are known per se and which have no bearing upon an understanding of the present invention.

With this in mind it will be seen that in the drawing we have illustrated and designated with reference numeral 1 a portion of a frame of the electrostatic copier. This frame 1 carries guide rails 2, 3 for the insertion and removal of a cleaning cartridge 4. This carriage is inserted into the copier from the exterior thereof in a manner which is also already known in the art, and can similarly be withdrawn in toto.

The cartridge 4 has sidewalls, one of which is visible in the drawing, and in these sidewalls there is journalled for rotation a cleaning brush roller 5 which in the illustrated embodiment is of the bristle type but could also be of the type having a jacket of synthetic plastic foam material in place of the bristles. The brush roller 5 is rotatable in the direction Indicated by the arrow B about an axis 5A and its periphery engages the photosensitive surface of a travelling electrostatic charge carrier 6 which is here in form of a fragmentarily shown cylindrical drum that rotates in the direction of the arrow A about an axis (not shown) parallel to the axis 5A. The engagement of the periphery of the brush roller 5 with the photosensitive surface of the drum 6 causes toner particles which still adhere to the surface of the drum 6 after transfer of the inner image (which takes place ahead of the cartridge 4, as seen in the direction of rotation A) to an image carrier. The bottom wall of the cartridge 4 is identified with reference numeral 7. A cleaning web is provided which is identified with reference numeral 8 and is in form of an elongated tape of a suitable cleaning material. Such materials are also known in the art and require no discussion. The cleaning web 8 is withdrawn in the direction of the arrow C from the diagrammatically illustrated supply roll S and is taken up on the similarly diagrammatically illustrated take-up roll TU, both of which are mounted in the cartridge 4.

The brush 5 brushes toner particles off the surface of the drum 6 and during its further rotation wipe over the cleaning tape 8 which is deflected upwardly towards it by being made to pass over a raised portion of the bottom wall, 7 so that on the edge region 7*a* of the raised portion contact begins between the bristles of the brush 5 and the cleaning tape 8. In the region 7*a* the toner particles picked up from the surface of the drum 6 are yielded by the brush 5 to the cleaning tape 8. In known manner the cleaning tape 8 is intermittently taken up onto the take-up TU, for example stepwise during each copy cycle, so that there will always be a clean portion of the cleaning tape 8 available in the region 7*a* where the brush 5 yields up the toner particles to the cleaning tape 8.

The cartridge 4, of which only the leading end portion is shown because it is only this end portion which is important for an understanding end portion. This is of course necessary so that the brush 5 can engage the periphery of the drum 6. At this leading end portion, or rather at the gaps define between the upper and lower edges of the cartridge 5, there normally exists an upper and a lower gap which extend lengthwise of the axis 5A and at which in the prior art dust-like toner particles can escape. According to the present invention there is provided a sealing roller 9 which extends along the lower gap, resting upon a portion of the cleaning tape 8 which is trained about the raised part of the bottom wall 7 of the cartridge 4, over the lip 7*b* and from there to the region 7*a* and towards the takeup TU. This sealing roller 9 is a section of bar material of circular cross-section, for example synthetic plastic material or the like the surface of which carries a flock layer of fine fibers 9*a* having a length of approximately 1 millimeter. It is also provided with axial bores 9*b* at its opposite axial end and these are substantially larger in diameter than the diameter of journal pins 12 (one dozen) which are mounted on the frame 1 adjacent the opposite axial ends of the roller 9, thus permitting the roller freedom of movement relative to the pins 12 in a certain sense, i.e. in two coordinate directions. The surface of the raised portion of the bottom wall 7, and hence the portions of the cleaning tape 8 which travel over the raised portion, is inclined to the horizontal H of an angle $\alpha$ as illustrated. It is on this surface that the periphery of the sealing roller 9 rests, so that due to this inclination the sealing roller 9 lightly engages the periphery of the drum 6 under its own weight. The movement of the cleaning tape 8 in the direction of the arrow C imparts to the roller 9 a rotary movement in the direction of the arrow D. The roller 9 thus seals the lower of the two gaps existing between the periphery of the drum 6 and the open end of the cartridge 4. The toner particles which are brushed off the surface of the drum 6 by the brush 5, fall onto the cleaning tape 8 and are thereby conveyed inwardly of the cartridge 4, either intermittently or continuously.

The upper gap between the cartridge 4 and the surface of the drum 6 is sealed by an elastically yieldable sealing strip 14, for example of rubber or a synthetic plastic material, such as PVC, PET, PUT or the like, This sealing strip 14 is lodged in a slot 13 extending in the upper edge portion of the cartridge 4 lengthwise of the axis 5A and having at is open side facing the periphery of the drum 6 a width *f* which is greater than would be required by the thickness *e* of the sealing strip 14 in the non-stressed condition of the latter. The strip 14 engages the surface of the drum 6 with the width of its entire edge face 15 and, due to the relationship of the width of the slot 13 at the open side thereof to the width of the strip 14, the latter can be very readily compressed and deformed and thus engages the surface of the drum 6 with a low and very uniform pressure. Thus, the upper of the two gaps is also reliably closed against the escape of toner dust.

The cartridge 4 is therefore reliably sealed against the escape of dust into the interior of the copier and, due to the arrangement according to the Invention, a precise positioning of the sealing means, which would for instance be necessary of a doctor blade were provided that extends into the extreme proximity of the surface of drum 6, can be avoided. Such precise positioning is very difficult due to tolerance variations in the size of the cartridge and in the position of the cartridge relative to the drum 6.

It will be understood that the cleaning tape 8 might be guided in a manner different from that illustrated, but the disclosed arrangement has been found to be particularly advantageous. The use of the sealing roller 9 has also been found to be very advantageous, because the roller 9 will automatically engage the surface of the drum 6 under the influence of its own weight, due to the fact that it rests on the inclined portion of the bottom wall 7 and of the cleaning web 8, so that no particular adjusting or guiding mechanisms are needed for the roller 9. An absolutely reliable seal is therefore provided under all circumstances. Moreover, the pressure with which the sealing roller 9 engages the periphery of the drum 6 is dependent exclusively upon the size of the angle $\alpha$ and is therefore independent of variations in the positioning of the cartridge 4 relative to the drum. This pressure is, of course, very low so that no damage to the sensitive surface of the drum will result. Any toner particles that drop onto the fibers 9*a* of the sealing roller 9 are yielded up thereby to the surface of the cleaning tape 8 and transported inwardly of the cartridge.

The sealing strip 14 could be mounted in a manner other than that illustrated. However, this also has been found to be very advantageous. The sealing strip 14 seals the upper edge of the open end of the cartridge 4 with reference to the surface of the drum 6, which surface is at this point of course already cleaned of toner particles. The sealing strip 14 can be made of any of the materials mentioned before, or it can be made of felt, or synthetic plastic foam material. It engages the surface of the drum 6 with a relatively light pressure but due to its softness can nevertheless be sufficiently compressed so that in compressed condition it is significantly thicker than in non-compressed or stressed condition. Use is made of this characteristic in the particular configuration of the dimensions of the open side of the slot 13. If the sealing strip 14 would be guided in the slot corresponding in thickness to the thickness of the strip in non-compressed condition, and if the material in which the slot is formed would extend closely adjacent to the surface of the drum 4, as in the present case, would engage the surface of the drum 6 with greatly differing pressures, sometimes even very high pressures, depending upon small differences in the spacing of the open end of the cartridge 4 from the surface of the drum 6. This undesired result is avoided due to the fact that adjacent its open side the slot 13 has a greater thickness *f* than the thickness *e* of the strip 14 in the un-compressed or un-stressed condition of the same. Therefore, the strip 14 engages the surface of the drum 6 with an always substantially uniform and low pressure, independently of tolerances in the size or position of the cartridge 4 relatative to the drum 6, since when it is compressed in transverse direction (i.e., from left to right in the drawing) it can become wider, i.e., the dimension *e* can increase. Despite this, the bending-over of the soft sealing strip 14 is not to be expected, because the sealing strip is guided and restrained against such bending close to the surface of the drum 6.

It will be understood that each of the elements described above, or two or more together, may also find a useful application in other types of applications differing from the types described above.

While the invention has been illustrated and described as embodied in a cleaning device for an electrostatic copier, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electrostatic copier of the type having a drum-shaped charge carrier rotatable about an axis of rotation and provided with a photosensitive surface which is electrostatically chargeable to form a latent image to which toner particles are attracted for subsequent transfer to an image carrier, and a cleaning arrangement for removing residual toner particles from said surface prior to the next electrostatic charging thereof, the improvement comprising a cleaning cartridge adapted for in toto insertion and removal from said copier, said cartridge having a leading open end in part bounded by two edges extending substantially parallel to said axis and cleaning means at said open end so as to engage said photosensitive surface when said cartridge is inserted into said copier, said cleaning means comprising a cleaning roller, a guide member below said cleaning roller and a cleaning tape which contacts the periphery of said cleaning roller and is trained about said guide member and has portions located proximal to said photosensitive surface in a position in which brushed-off toner particles drop onto said portions; and yieldable sealing means at said cartridge at least in part bounding said open end and yieldingly sealing said open end in engagement with said photosensitive surface in response to insertion of said cartridge into said copier, said sealing means comprising a sealing roller extending along said portions lengthwise of said drum and sealingly engaging said portions and said photosensitive surface.

2. The improvement as defined in claim 1, wherein said portions form a toner particle intercepting face which is slightly inclined to the horizontal in direction towards said photosensitive surface.

3. The improvement as defined in claim 1, wherein said sealing roller is mounted with freedom of movement in two coordinate directions relative to said portions and said photosensitive surface and engages both under the influence of its weight.

4. In an electrostatic copier of the type having an endless charge carrier travelling in a path and provided with a photosensitive surface which is electrostatically chargeable to form a latent image to which toner particles are attracted for subsequent transfer to an image carrier, and a cleaning arrangement for removing residual toner particles from said surface prior to the next electrostatic charging thereof, the improvement comprising a cleaning cartridge adapted for in toto insertion and removal from said copier, said cartridge having a leading open end bounded in part by two edges each extending transverse to said path along said photosensitive surface and defining with said surface an upper and a lower gap which communicate with the interior of said cartridge, and cleaning means at said open end so as to engage said photosensitive surface when said cartridge is inserted into said copier, including a cleaning tape having portions extending across said lower gap and defining with said surface a slot; and sealing means at said cartridge and yieldingly sealing both of said gaps in engagement with said photosensitive surface in response to insertion of said cartridge into said copier, said sealing means including a sealing roller turnably resting on said portions upwardly spaced from said slot in sealing engagement with said portions and said surface.

5. In an electrostatic copier of the type having a drum-shaped charge carrier rotatable about an axis of rotation and provided with a photosensitive surface which is electrostatically chargeable to form a latent image to which toner particles are attracted for subsequent transfer to an image carrier, and a cleaning arrangement for removing residual toner particles from said surface prior to the next electrostatic charging thereof, the improvement comprising a cleaning cartridge adapted for in toto insertion and removal from said copier, said cartridge having a leading open end in part bounded by two edges extending substantially parallel to said axis and cleaning means at said open end so as to engage said photosensitive surface when said cartridge is inserted into said copier, said cleaning means comprising a brush roller and a cleaning tape which contacts the periphery of said brush roller; and yieldable sealing means at said cartridge at least in part bounding said open end and yieldingly sealing said open end in engagement with said photosensitive surface in response to insertion of said cartridge into said copier, said sealing means comprising elongated sealing elements extending along said edges, one of said elements which extends along an upper one of said edges being a sealing strip baving a longitudinally extending side face which is in its entirety in sealing contact with said upper surface and said upper edge being formed with a longitudinally extending slot in which said sealing strip is mounted.

6. The improvement as defined in claim 5, whrein said slot has an open side facing towards said photosensitive surface, the transverse dimension of said slot in the region of said open side being slightly greater than the thickness of said sealing strip in undeformed condition.

* * * * *